US007743846B2

(12) United States Patent
Gensmann et al.

(10) Patent No.: US 7,743,846 B2
(45) Date of Patent: Jun. 29, 2010

(54) ROTARY SPINDLE FOR POWER TOOL AND POWER TOOL INCORPORATING SUCH SPINDLE

(75) Inventors: Stefan D. Gensmann, Früchtl (DE); Martin Lauterwald, Huenstetten (DE); Reimund Becht, Hünfelden (DE)

(73) Assignee: Black & Decker Inc., Newark, DE (US)

( * ) Notice: Subject to any disclaimer, the term of this patent is extended or adjusted under 35 U.S.C. 154(b) by 0 days.

(21) Appl. No.: 11/146,180

(22) Filed: Jun. 6, 2005

(65) Prior Publication Data

US 2005/0271489 A1 Dec. 8, 2005

(30) Foreign Application Priority Data

Jun. 5, 2004 (GB) ..... 0412594.4

(51) Int. Cl.
*B25D 17/00* (2006.01)

(52) U.S. Cl. ..... 173/104; 173/109; 173/111; 173/122

(58) Field of Classification Search ..... 173/104, 173/109, 111, 122, 205; 279/19, 19.3, 19.5, 279/19.6

See application file for complete search history.

(56) References Cited

U.S. PATENT DOCUMENTS 2,451,234 A * 10/1948 Mitchell ..... 279/19.6
2,478,195 A * 8/1949 Hull ..... 279/145
2,736,561 A 2/1956 Hansen
2,926,020 A 2/1960 Dayton et al.
3,734,516 A 5/1973 Smith
3,743,307 A 7/1973 Benjamin et al.
4,107,949 A 8/1978 Wanner et al.
4,114,699 A 9/1978 Wolf
4,131,165 A 12/1978 Wanner et al.
4,429,775 A * 2/1984 Teramoto ..... 477/178
4,434,859 A 3/1984 Rumpp et al.
4,477,095 A * 10/1984 Atkinson, III ..... 279/145
4,491,444 A 1/1985 Rumpp et al.
4,491,445 A * 1/1985 Hunger et al. ..... 409/234
4,502,824 A * 3/1985 Dohse et al. ..... 409/234
4,547,105 A 10/1985 Hofle et al.
4,592,560 A 6/1986 Neumaier et al.

(Continued)

FOREIGN PATENT DOCUMENTS

DE 36 13 526 A1 10/1987

(Continued)

*Primary Examiner*—Rinaldi I. Rada
*Assistant Examiner*—Nathaniel Chukwurah
(74) *Attorney, Agent, or Firm*—Kofi Schulterbrandt; Scott B. Markow; Adan Ayala

(57) ABSTRACT

A rotary spindle 4 for a power tool such as a hammer drill is disclosed. The spindle 4 comprises a first spindle part 402 for rotation about its longitudinal an axis by means of a motor and having an inwardly directed rim 406, and a second spindle part 404 for supporting a drill bit of the hammer drill and having an outwardly directed rim 410. The second spindle part 404 extends through an aperture 408 in the first spindle part 402 and rims 406, 410 cooperate with each other to prevent removal of the second spindle part 404 from the first spindle part 402. A circlip 414 locks the first and second spindle parts 402, 404 together and maintains o-rings 412 under compression.

34 Claims, 2 Drawing Sheets

U.S. PATENT DOCUMENTS

| | | | | | |
|---|---|---|---|---|---|
| 4,691,929 | A | | 9/1987 | Neumaier et al. | |
| 4,710,079 | A | | 12/1987 | Smith et al. | |
| 4,775,269 | A | | 10/1988 | Brix | |
| 4,824,298 | A | | 4/1989 | Lippacher et al. | |
| 4,878,679 | A | * | 11/1989 | Plank et al. | 279/19.4 |
| 5,042,848 | A | | 8/1991 | Shiozaki | |
| 5,199,833 | A | | 4/1993 | Fehrle et al. | |
| 5,201,620 | A | | 4/1993 | Forrest et al. | |
| 5,222,956 | A | * | 6/1993 | Waldron | 606/80 |
| 5,316,323 | A | | 5/1994 | Jovanovic | |
| 5,373,905 | A | | 12/1994 | Bleicher et al. | |
| 5,379,848 | A | * | 1/1995 | Rauser | 173/48 |
| 5,398,946 | A | * | 3/1995 | Quiring | 279/30 |
| 5,437,465 | A | | 8/1995 | Vogele et al. | |
| 5,474,139 | A | | 12/1995 | Odendahl et al. | |
| 5,558,478 | A | | 9/1996 | Odendahl et al. | |
| 5,588,496 | A | | 12/1996 | Elger | |
| 5,603,516 | A | | 2/1997 | Neumaier | |
| 5,674,031 | A | | 10/1997 | Bilz et al. | |
| 5,678,961 | A | * | 10/1997 | Fleege et al. | 408/239 A |
| 5,706,903 | A | | 1/1998 | Odendahl et al. | |
| 5,709,391 | A | | 1/1998 | Arakawa et al. | |
| 5,954,347 | A | | 9/1999 | Buck et al. | |
| 5,971,403 | A | | 10/1999 | Yahagi et al. | |
| 6,089,330 | A | | 7/2000 | Miescher et al. | |
| 6,092,814 | A | | 7/2000 | Kageler | |
| 6,116,352 | A | * | 9/2000 | Frauhammer et al. | 173/212 |
| 6,173,792 | B1 | | 1/2001 | Hald | |
| 6,497,418 | B2 | | 12/2002 | Yahagi | |
| 6,732,815 | B2 | * | 5/2004 | Hanke et al. | 173/201 |
| 2001/0048855 | A1 | | 12/2001 | Lin | |
| 2002/0151902 | A1 | * | 10/2002 | Riedel et al. | 606/80 |
| 2005/0224243 | A1 | * | 10/2005 | Baumann et al. | 173/128 |

FOREIGN PATENT DOCUMENTS

| | | | |
|---|---|---|---|
| GB | 618546 | | 2/1949 |
| GB | 2 276 578 | A | 10/1994 |
| GB | 2 324 482 | A | 10/1998 |
| WO | WO 03/035321 | A3 | 5/2003 |
| WO | 2004007149 | | 1/2004 |

* cited by examiner

ROTARY SPINDLE FOR POWER TOOL AND POWER TOOL INCORPORATING SUCH SPINDLE

FIELD OF THE INVENTION

The present invention relates to rotary spindles for power tools, and relates particularly, but not exclusively, to rotary spindles for hammer drills. The invention also relates to power tools incorporating such spindles.

BACKGROUND OF THE INVENTION

Electrically driven hammer drills are known in which a motor causes a driving member in the form of a flying mass to be reciprocally driven in a hollow spindle by means of piston, while at the same time causing the piston to rotate about its longitudinal axis. The spindle supports a working member such as a drill bit, either by direct mounting of the drill bit to the spindle, or by supporting a tool holder which in turn supports the drill bit, such that rotation of the spindle about its axis causes rotation of the drill bit to effect a drilling action, while reciprocating movement of the flying mass within the spindle imparts hammer impacts to the drill bit.

The spindle of a hammer drill of such known types is generally manufactured in a single piece. As a result, the entire spindle generally needs to be constructed as robustly as that part of the spindle subjected to the greatest amount of wear, even though most of the spindle does not need to be constructed to such a level of robustness. This significantly increases the cost and difficulty of manufacturing the hammer drill. Furthermore, when the hammer drill is repaired, the entire spindle generally needs to be replaced, even if only part of the spindle is damaged, which makes repair of the drill costly.

U.S. Pat. No. 5,373,905 discloses a hammer drill in which a spindle in which a striker mass is reciprocally driven is formed from two separate parts, i.e. a guide tube, and a tool socket arranged forwardly of the guide tube, the guide tube and tool socket overlapping each other in a certain region and being connected to each other by means of a press fit. As a result, only the tool socket needs to be formed from a robust, high-grade material, which significantly reduces the cost of manufacture and repair of the drill.

However, this arrangement suffers from the drawbacks that because the guide tube and tool socket are connected to each other by means of a press fit, the cooperating parts of the guide tube and tool socket must be manufactured to accurate dimensions, as a result if which manufacture of the drill is still costly. Also, the hammering action of the striker mass against the tool socket causes the tool socket to tend to detach from the guide sleeve, as a result of which components such as profiled rings securing the guide tube and tool socket together are subjected to significant stresses and can become damaged and must be frequently replaced.

Preferred embodiments of the present invention seek to overcome the above disadvantages of the prior art.

BRIEF SUMMARY OF THE INVENTION

According to an aspect of the present invention, there is provided a rotary spindle for a power tool, the spindle comprising:— a first spindle member having at least one first abutment portion adjacent a first end thereof;

a second spindle member for supporting a working member of the power tool adjacent a first end thereof for rotation with said second spindle member about said axis, wherein said second spindle member is adapted to extend through an aperture adjacent said first end of said first spindle member and has at least one second abutment portion adjacent a second end thereof for cooperating with at least one said first abutment portion of said first spindle member to prevent removal of said second spindle member from said first end of said first spindle member in a first direction;

locking means for preventing removal of said second spindle member from said first end of said first spindle member in a second direction, opposite to said first direction; and biasing means for urging said second spindle member in said second direction relative to said first spindle member.

By providing first and second abutment portions for preventing removal of the second spindle member from the first spindle member in a first direction, and biasing means for urging the second spindle member in a second direction, opposite to the first direction, relative to the first spindle member, this provides the advantage of minimising the tendency of impacts on the second spindle member to cause the second spindle member to become detached from the first spindle member. In addition, by providing at least one first abutment portion which cooperates with at least one second abutment portion, this provides the advantage that the first and second spindle members no longer need to fit together by means of a press fit, as a result of which the first and second spindle members do not require cooperating parts manufactured to as high a degree of accuracy as prior art devices having two-part spindles. This in turn reduces the cost of manufacture of the spindle and therefore of apparatus incorporating the spindle.

The first spindle member may be adapted to be rotated by a motor of the power tool. However, the spindle may be arranged such that there is no rotary movement, the power tool only impacting hammer impacts on the drill bit.

At least one said second abutment portion may comprise a rim extending outwardly of said axis.

In the case where the spindle forms part of a power tool having hammer action, for example a hammer drill, this provides the advantage of enabling direct impact of a beat piece flying mass of a hammer mechanism of the tool against the first spindle member to be avoided, which in turn minimises wear and damage to the first spindle member, thus increasing the useful lifetime of the first spindle member.

At least one said second abutment portion may comprise a rim extending towards said axis.

Said biasing means may include at least one resilient member.

At least one said resilient member may comprise an O-ring arranged between a said first abutment portion and a said second abutment portion.

Said damping means may comprise at least one compression spring.

Said locking means may comprise at least one removable member adapted to be mounted to said second spindle member on a side of a said first abutment portion opposite to said biasing means.

This provides the advantage of minimising the extent to which the or each removable member is subjected to wear by hammer impacts on the second spindle member.

At least one said removable member may comprise a metal clip.

Said first and second spindle members may comprise cooperating engaging means for preventing rotation of said second spindle member about said axis relative to said first spindle member.

Said cooperating engaging means may comprise a plurality of splines on one of said first and second spindle members and a plurality of grooves on the other of said first and second spindle members.

According to another aspect of the present invention, there is provided a power tool comprising a housing, a motor having an output shaft for actuation of a working member of the tool, and a spindle as defined above for rotation about said axis by means of said motor.

BRIEF DESCRIPTION OF THE DRAWINGS

A preferred embodiment of the present invention will now be described, by way of example only and not in any limitative sense, with reference to the accompanying drawings, in which:—

DETAILED DESCRIPTION OF THE INVENTION

Figure 1:
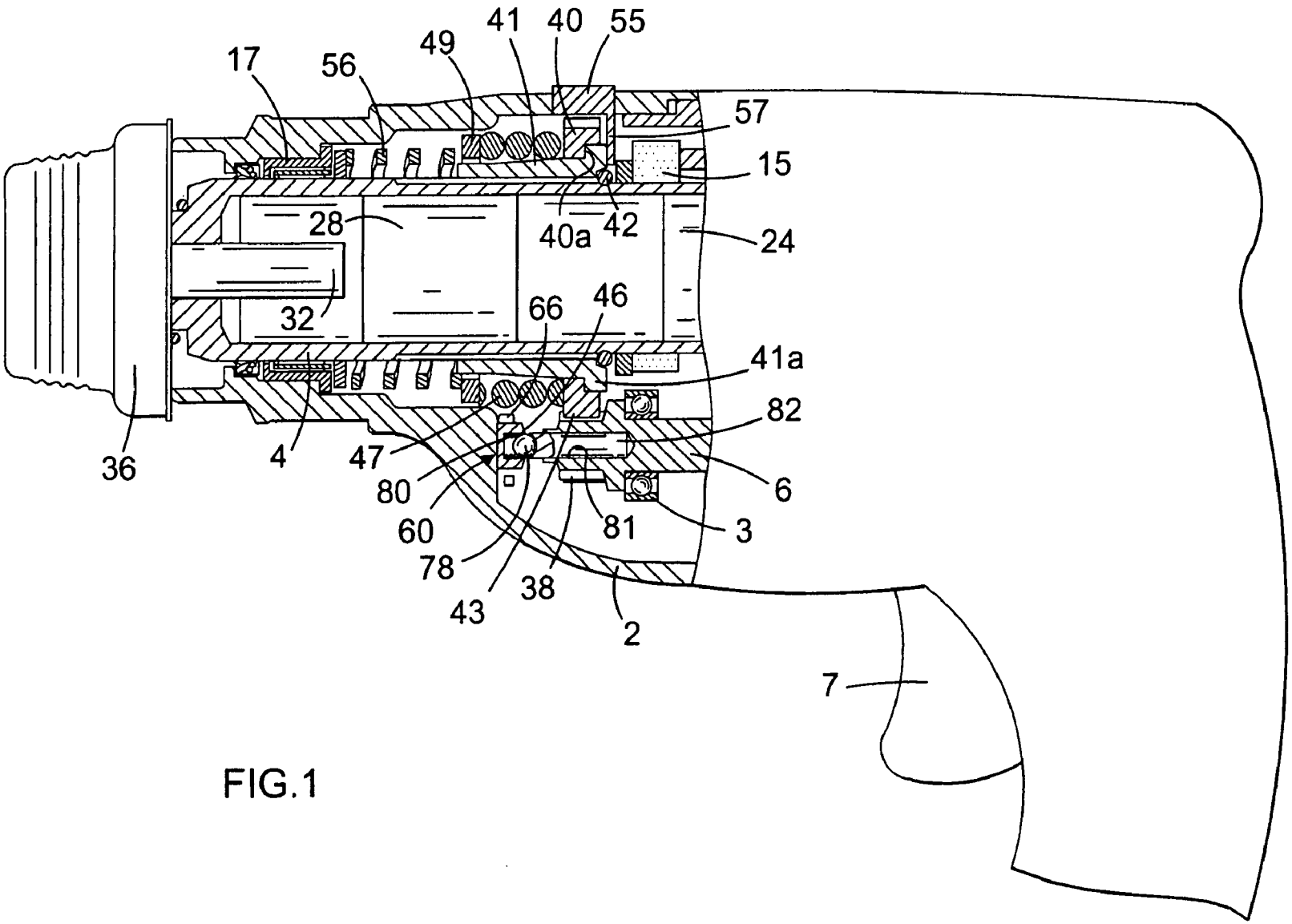
FIG. 1 is a schematic cross-sectional view of a forward part of a hammer drill embodying the present invention.

Referring to FIG. 1, a rotary hammer has a forward portion shown in cross-section, and a rear portion incorporating a motor and pistol grip rear handle in a conventional manner. Alternatively, the handle may be of the D handle type. The handle portion incorporates a trigger switch 7 for actuating an electric motor which carries a pinion (not shown) at the forward end of its armature shaft. The pinion of the motor rotatingly drives an intermediate shaft 6 via a gear which is press fit onto the rearward end of the intermediate shaft 6. The intermediate shaft 6 is rotatably mounted in a housing 2 of the hammer via a first bearing (not shown) located at the rearward end of the intermediate shaft 6 and a forward bearing 3 located at the forward end of the intermediate shaft 6.

A wobble drive hammering mechanism, of a type which will be familiar to persons skilled in the art, is provided for reciprocatingly driving a piston 24. The piston 24 is slidably located within a hollow cylindrical spindle 4 and an O-ring seal (not shown) is mounted around the piston 24 so as to seal between the periphery of the piston 24 and the internal surface of the spindle 4. A ram 28 is slidably mounted within the spindle 4 and an O-ring seal (not shown) is mounted around the ram 28 so as to seal between the periphery of the ram 28 and the internal surface of the spindle 4. In this way, during normal operation of the hammer, a closed air cushion is formed between the forward face of the piston 24 and the rear face of the ram 28, which causes the ram to be reciprocatingly driven by the piston via the closed air cushion. During normal operation of the hammer, the ram 28 repeatedly impacts a beat piece 32, which is reciprocatingly mounted within the spindle 4. The beat piece 32 transfers impacts from the ram 28 to a tool or bit (not shown) mounted within a forward tool holder portion of the spindle 4 by means of a tool holder arrangement 36, of a type which will be familiar to persons skilled in the art. The tool or bit is releasably locked within the tool holder portion of the spindle 4 so as to be able to reciprocate within the tool holder portion of the spindle by a limited amount.

The spindle 4 is rotatably mounted in the hammer housing 2 by means of bearings 15, 17. Simultaneously with, or as an alternative to, the hammering action generated by the hammering mechanism described above, the spindle 4 can be rotatingly driven by the intermediate shaft 6 as described below. Thus, as well as reciprocating, the tool or bit is rotatingly driven because it is non-rotatably mounted within the spindle 4 by the tool holder arrangement 36.

An overload clutch mechanism includes a spindle drive gear 40 rotatably and axially slidably mounted on a slider sleeve 41, and the slider sleeve 41 is non-rotatably and axially slidably mounted on the spindle 4. The spindle drive gear 40 is formed on its periphery with a set of teeth 43. The intermediate shaft 6 is formed at its forward end with a pinion 38 and the teeth 43 of the spindle drive gear 40 may be brought into engagement with the pinion 38 in order to transmit rotary drive to the slider sleeve 41 and thereby to the spindle 4. The spindle drive gear 40 transmits rotary drive to the slider sleeve 41 via the overload clutch arrangement. The spindle drive gear 40 has a set of rearwardly facing teeth 40*a* formed on a rearward facing surface thereof, this set of teeth 40*a* being biased into engagement with a set of teeth formed on a forward facing surface 41*a* on an annular flange of the slider sleeve 41. The sets of teeth are biased into engagement with each other by a spring 47 mounted on the slider sleeve 41 to extend between a washer 49 axially fixedly mounted at the forward end of the slider sleeve 41, and a forward facing end surface of the spindle drive gear 40.

The slider sleeve 41 is axially biased by means of a spring 56 into a rearward position against an elastomeric O-ring 42 mounted in a recess formed in the external surface of the spindle 4 and having an inclined surface. In the rearward position, the hammer is in a rotary mode and rotation of the intermediate shaft 6 is transmitted to the spindle 4, provided the torque transmitted is below a threshold torque of the overload clutch.

The slider sleeve 41 can also be moved into a forward position against the biasing force of the spring 56 via a mode change mechanism. In the forward position, the spindle drive gear 40 is moved on the slider sleeve 41 forwardly out of engagement with the intermediate shaft pinion 38 and into engagement with a spindle lock arrangement 60, the function of which is not relevant to the present invention and will therefore not be described in further detail. With the slider sleeve 41 and spindle drive gear 40 in a forward position, the hammer is in a non-rotary mode with the spindle 4 fixed against rotation. The mode change arrangement may comprise a mode change knob 55 rotatably mounted on the housing 2 and having an eccentric pin 57 which is engageable with the rearward face of the annular flange 41*a* of the slider sleeve 41 to move the slider sleeve forwardly.

In the position shown in FIG. 1, the spring 56 biases the slider sleeve 41 into its rearward position. However, on rotation of the mode change knob through 180 degrees from its position shown in FIG. 1, the eccentric pin 57 pulls the slider sleeve 41 forwardly against the biasing force of the spring 56. The eccentric pin 57 then pulls the slider sleeve 41 forwardly to move the spindle drive gear 40 out of engagement with the pinion 38 of the intermediate shaft 6 and into engagement with the spindle lock arrangement 60.

Figure 2:
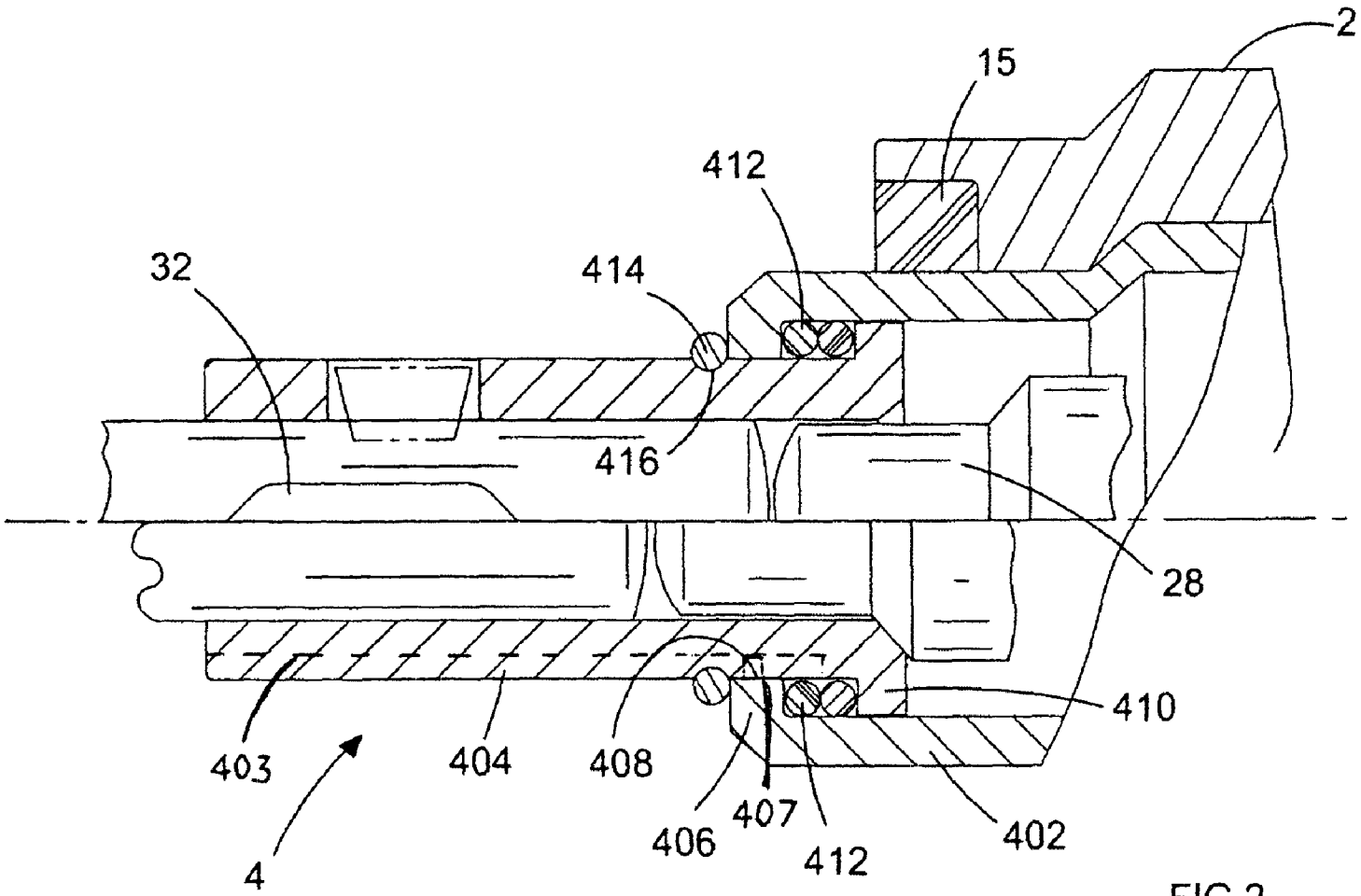
FIG. 2 is a schematic cross-sectional view of a rotary spindle of the hammer drill of FIG. 1.

Referring now to FIG. 2, the spindle 4 of the apparatus of FIG. 1 is formed as a two part spindle 4 comprising a first spindle part 402 arranged rearwardly of a second spindle part 404 for supporting beat piece 32 for imparting impacts to a drill bit (not shown). The first spindle part 402 has an inwardly directed rim 406 at a forward part thereof defining a splined aperture 408 for slidably and non-rotatably receiving second spindle part 404. The second spindle part 404 is provided with an outwardly directed rim 410 at a rear end thereof, and a pair of rubber O-rings 412 are arranged between the flanges rims 406, 410. To prevent rotation of the second spindle member about the axis relative to the first spindle member, the second spindle members may include at least one groove 403 and the first spindle member may include at least one radial spline 407 to engage the groove 403.

The second spindle part 404 is made of more robust material than first spindle part 402 and is held in position relative to the first spindle part 402 by means of resilient metal circlip 414 arranged to grip second spindle part 404 in a groove 416 thereof to maintain rubber O-rings 412 under compression to prevent axial movement of second spindle part 404 relative to first spindle part 402.

In order to assemble the spindle 4, the second spindle part 404 is urged outwardly of the aperture 408 in first spindle part 402 until the rubber O rings 412 are placed under compression between the rims 406, 410. The circlip 414 then secures the second spindle part 404 in position relative to the first spindle part 402.

During operation of the hammer drill, the motor causes the two-part spindle 4 to rotate about its longitudinal axis, while reciprocally driving the ram 28 axially in the hollow spindle 4 to impart impacts to the beat piece 32. The ram 28 only impacts against the second spindle part 404, as a result of which wear and damage to the first spindle part 402 is minimised, and only the second spindle part 404 need be replaced during repair of the hammer drill.

It will be appreciated by persons skilled in the art that the above embodiment has been described by way of example only, and not in any limitative sense, and that various alterations and modifications are possible without departure from the scope of the invention as defined by the appended claims. For example, rubber O-rings 412 may be replaced by a compression spring.

The invention claimed is:

1. A spindle for a power tool, the spindle comprising:

a first spindle member having at least one first abutment portion adjacent a first end thereof;

a second spindle member for supporting a working member of the power tool adjacent a first end thereof for rotation with said second spindle member about an axis, wherein said second spindle member is adapted to extend through an aperture adjacent said first end of said first spindle member and has at least one second abutment portion adjacent a second end thereof for cooperating with at least one said first abutment portion of said first spindle member to prevent removal of said second spindle member from said first end of said first spindle member in a first direction;

locking means for preventing removal of said second spindle member from said first end of said first spindle member in a second direction, opposite to said first direction; and biasing means for urging said second spindle member in said second direction relative to said first spindle member, wherein the first spindle member transmits rotational energy from a motor of the power tool to the second spindle member; and wherein said biasing means includes at least one resilient member; and wherein at least one said resilient member comprises an O-ring arranged between said first abutment portion and said second abutment portion.

2. A spindle according to claim 1, wherein at least one said second abutment portion comprises a rim extending outwardly of said axis.

3. A spindle according to claim 1, wherein at least one said second abutment portion comprises a rim extending towards said axis.

4. A spindle according to claim 1, wherein said locking means comprises at least one removable member adapted to be mounted to said second spindle member on a side of said first abutment portion opposite to said biasing means.

5. A spindle according to claim 4, wherein at least one said removable member comprises a metal clip.

6. A spindle according to claim 1, wherein said first and second spindle members comprise cooperating engaging means for preventing rotation of said second spindle member about said axis relative to said first spindle member.

7. A spindle according to claim 6, wherein said cooperating engaging means comprise a plurality of splines on one of said first and second spindle members and a plurality of grooves on the other of said first and second spindle members.

8. A spindle according to claim 1, wherein the spindle is a rotary spindle, the first spindle member being adapted to be rotated about an axis by means of a motor of the power tool.

9. A spindle according to claim 1 wherein said locking means is distinct from said first abutment portion and cooperatively engages said first abutment portion on a side of said first abutment portion that is opposite said biasing means.

10. A spindle according to claim 9 wherein said locking means comprises a removable member that nests in a groove defined in said second spindle member.

11. A spindle according to claim 1 wherein said locking means is distinct from said first abutment portion and wherein said first abutment portion concurrently engages said biasing member on one end and said locking means on another end.

12. A spindle according to claim 1 wherein said first spindle defines an inner diameter sized to slidably accommodate an outer diameter of said second spindle during removal of said second spindle from said first spindle in said second direction.

13. A spindle according to claim 1 wherein said first abutment portion is integrally formed with said first spindle.

14. A spindle according to claim 1 wherein said first spindle defines a first inner diameter outboard of said biasing means and defines a second inner diameter at said first abutment portion, wherein said second diameter is less than said first diameter.

15. A spindle according to claim 1 wherein said locking means comprises a resilient member that engages and urges said first abutment portion into said biasing member causing said biasing member to be placed in compression between said first and second abutment portions.

16. A power tool comprising:

a housing;

a motor having an output shaft for actuation of a working member of the tool; and a spindle comprising a first spindle member having at least one first abutment portion adjacent a first end thereof;

a second spindle member for supporting a working member of the power tool adjacent a first end thereof for rotation with said second spindle member about an axis, wherein said second spindle member is adapted to extend through an aperture adjacent said first end of said first spindle member and has at least one second abutment portion adjacent a second end thereof for cooperating with at least one said first abutment portion of said first spindle member to prevent removal of said second spindle member from said first end of said first spindle member in a first direction;

locking means for preventing removal of said second spindle member from said first end of said first spindle member in a second direction, opposite to said first direction; and biasing means for urging said second spindle member in said second direction relative to said first spindle member, wherein the first spindle member transmits rotational energy from the motor of the power tool to the second spindle member; and wherein said biasing means includes at least one resilient member; and wherein at least one said resilient member comprises an O-ring arranged between said first abutment portion and said second abutment portion.

17. A spindle according to claim 16 wherein said locking means is distinct from said first abutment portion and cooperatively engages said first abutment portion on a side of said first abutment portion that is opposite said biasing means.

18. A spindle according to claim 17 wherein said locking means comprises a removable member that nests in a groove defined in said second spindle member.

19. A spindle according to claim 16 wherein said locking means is distinct from said first abutment portion and wherein said first abutment portion concurrently engages said biasing member on one end and said locking means on another end.

20. A spindle according to claim 16 wherein said first spindle defines an inner diameter sized to slidably accommodate an outer diameter of said second spindle during removal of said second spindle from said first spindle in said second direction.

21. A spindle according to claim 16 wherein said first abutment portion is integrally formed with said first spindle.

22. A spindle according to claim 21 wherein said first spindle defines a first inner diameter outboard of said biasing means and defines a second inner diameter at said first abutment portion, wherein said second diameter is less than said first diameter.

23. A spindle according to claim 16 wherein said locking means comprises a resilient member that engages and urges said first abutment portion into said biasing member causing said biasing member to be placed in compression between said first and second abutment portions.

24. A spindle for a power tool, the spindle comprising:

a first spindle member having at least one first abutment portion adjacent a first end thereof;

a second spindle member for supporting a working member of the power tool adjacent a first end thereof for rotation with said second spindle member about an axis, wherein said second spindle member is adapted to extend through an aperture adjacent said first end of said first spindle member and has at least one second abutment portion adjacent a second end thereof for cooperating with at least one said first abutment portion of said first spindle member to prevent removal of said second spindle member from said first end of said first spindle member in a first direction;

locking means for preventing removal of said second spindle member from said first end of said first spindle member in a second direction, opposite to said first direction;

biasing means for urging said second spindle member in said second direction relative to said first spindle member; and wherein said first and second spindle members comprise cooperating engaging means for preventing rotation of said second spindle member about said axis relative to said first spindle member;

wherein the first spindle member transmits rotational energy from a motor of the power tool to the second spindle member; and wherein said biasing means includes at least one resilient member; and wherein at least one said resilient member comprises an O-ring arranged between said first abutment portion and said second abutment portion.

25. A spindle according to claim 24, wherein said cooperating engaging means comprise a plurality of splines on one of said first and second spindle members and a plurality of grooves on the other of said first and second spindle members.

26. A spindle according to claim 24, wherein at least one said second abutment portion comprises a rim extending outwardly of said axis.

27. A spindle according to claim 24, wherein at least one said second abutment portion comprises a rim extending towards said axis.

28. A spindle according to claim 24, wherein said locking means comprises at least one removable member adapted to be mounted to said second spindle member on a side of said first abutment portion opposite to said biasing means.

29. A spindle according to claim 28, wherein at least one said removable member comprises a metal clip.

30. A spindle for a power tool, the spindle comprising:

a first spindle member having a first abutment portion adjacent a first end thereof;

a second spindle member that supports a working member of the power tool at a first end thereof for rotation with said second spindle member about an axis, wherein said first end of said second spindle member is adapted to be passed in a first direction through an aperture defined at said first end of said first spindle member and has a second abutment portion adjacent a second end thereof for cooperating with said first abutment portion of said first spindle member to prevent complete passage of said second spindle member through said aperture in said first direction;

locking means for precluding movement of said second spindle member in a second direction, opposite to said first direction; and biasing means that urges said first and second abutment portions apart, wherein the first spindle member transmits rotational energy from a motor of the power tool to the second spindle member; and wherein said biasing means includes at least one resilient member; and wherein at least one said resilient member comprises an O-ring arranged between said first abutment portion and said second abutment portion.

31. A spindle according to claim 30 wherein said locking means is distinct from said first abutment portion and wherein said first abutment portion concurrently engages said biasing member on one end and said locking means on another end.

32. A spindle according to claim 30 wherein said first abutment portion is integrally formed with said first spindle.

33. A spindle according to claim 32 wherein said first spindle defines a first inner diameter outboard of said biasing means and defines a second inner diameter at said first abutment portion, wherein said second diameter is less than said first diameter.

34. A spindle according to claim 30 wherein said locking means comprises a resilient member that engages and urges said first abutment portion into said biasing member causing said biasing member to be placed in compression between said first and second abutment portions.

* * * * *